United States Patent [19]

Shimazu et al.

[11] Patent Number: 4,915,649

[45] Date of Patent: Apr. 10, 1990

[54] CONNECTOR

[75] Inventors: Hiroyuki Shimazu; Kazuo Mitsui, both of Kanagawa, Japan

[73] Assignee: Sumitomo Wiring Systems, Ltd., Mie, Japan

[21] Appl. No.: 221,913

[22] Filed: Jul. 20, 1988

[30] Foreign Application Priority Data

Jul. 21, 1987 [JP] Japan ..... 62-112447[U]

[51] Int. Cl.[4] ..... H01R 3/00; H01R 13/71

[52] U.S. Cl. ..... 439/490; 439/489

[58] Field of Search ..... 439/188, 488–491, 439/507–514, 350, 357; 200/51.09, 51.1, 51.11

[56] References Cited

U.S. PATENT DOCUMENTS 3,611,261 10/1971 Gregory .
4,386,818 6/1983 Millhimes et al. ..... 439/490
4,452,501 6/1984 Gladd et al. .
4,786,258 11/1988 Shaffer et al. ..... 439/188

FOREIGN PATENT DOCUMENTS 621744 7/1980 Japan .

*Primary Examiner*—Eugene F. Desmond
*Attorney, Agent, or Firm*—Wenderoth, Lind & Ponack

[57] ABSTRACT

A connector comprises a housing provided with a recess (7), a terminal cavity (9) and a gap (10), and a contact piece (2) provided with a base portion (2') and bifurcated free ends (3, 3'). Contact terminals (6, 6') of wires (W, W'), project into the recess through the terminal cavity. The base portion of the contact piece is fitted into the gap, the bifurcated free ends of the contact piece project into the recess, and only one of the bifurcated free ends is normally in contact with one of the contact terminals. Therefore, when an arm of the housing of an other connector is fitted into the recess, the other of the bifurcated free ends is brought into contact with the other of the contact terminals and completes an electrical connection between them.

4 Claims, 2 Drawing Sheets

CONNECTOR

BACKGROUND OF THE INVENTION

1. Field of the Invention

The present invention relates to a connector used with a wire-harness for automobiles.

2. Prior Art

A prior art connector used with a wire-harness for automobiles is disclosed in, for example, the Official Gazette of Japanese Utility Model Public Disclosure No. 1744/87. In this prior art connector, male and female connectors are provided with an electric contact in each of a locking portion and a locked portion on a side wall thereof so that the electric contacts provided in the locking and locked portions are connected to each other when the two connectors are fitted to each other and the locking and the locked portions are engaged with each other. An indication as to whether or not the fitting of the two connectors is perfect is given by an indicating lamp or the like provided in a circuit which is made conductive upon connection of the electric contacts.

In this type of connector, however, in which the electric contacts provided in the locking and the locked portions, respectively, are directly connected, it is required that at least one of the contacts yields to pressure when the connectors are fitted to each other. Accordingly, repeated fitting and detaching of the prior art connectors will cause metal fatigue and lead to an insecure connection between them.

SUMMARY OF THE INVENTION

In order to overcome the difficulties of the prior art connector described above, the connector according to the present invention has a construction in which a housing is provided on its outer side with a locking portion having a recess for engagement with an arm of the other housing and said recess is provided therein with a pair of contact terminals parallel to the direction in which the housings are fitted and a highly resilient contact piece having bifurcated free ends, one of which is normally in contact with one of said contact terminals and the other of which is in the vicinity of the other of the contact terminals with an adequate clearance therebetween, so that, when the arm of the other housing is caught in said recess of the housing during the action of fitting the housings together, an indication as to whether or not the fitting of the housings is perfect is given, for example, by a lamp, when a contact piece is urged by said arm into contact with said contact terminal, thereby bringing said pair of contact terminals into electrical connection.

Because a pair of parallel contact terminals and the contact piece having the bifurcated free ends are provided in the recess defined in one of the housings and because one of the free ends of the contact piece is normally in contact with one of the contact terminals while the other of the free ends is opposite to the other of the contact terminals with an adequate clearance therebetween, when the one housing is fitted to the other housing and the arm of the housing is caught in the recess, the leading end of the arm urges one of the free ends of the contact piece into contact with the other contact terminal directly under it, thereby bringing them into electrical connection.

The circuit which includes a lamp or the like is energized by the procedure described above and an indication as to whether or not the fitting of the housings is perfect is given according to whether the lamp is lit or not.

BRIEF DESCRIPTION OF THE DRAWINGS

The invention will be better understood from the following description taken in connection with the accompanying drawings in which.

DETAILED DESCRIPTION OF THE EMBODIMENTS:

Certain preferred embodiments of the present invention will now be described with reference to the accompanying drawings.

Figure 1:
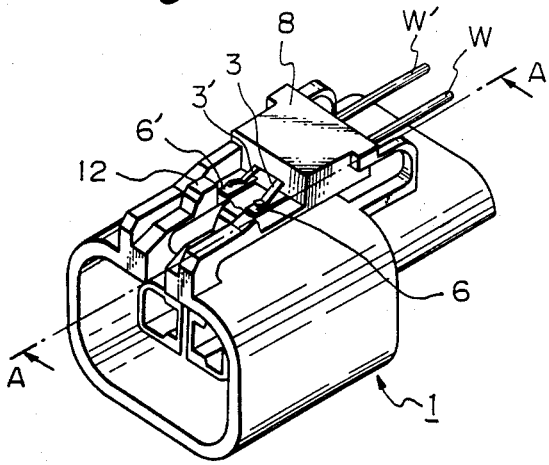
FIG. 1 is a perspective view of a connector according to the present invention.
Figure 2A:
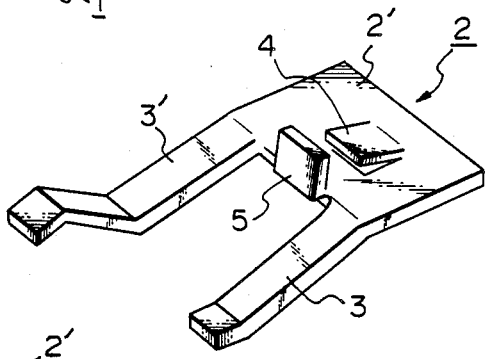
FIGS. 2A and 2B are perspective views of contact pieces.
Figure 2B:
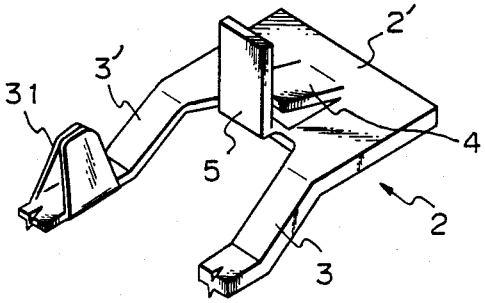
Figure 3:
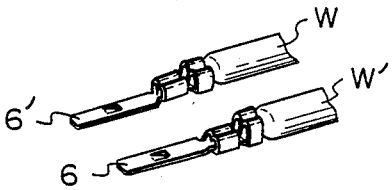
FIG. 3 is a perspective view of a contact terminal.

In FIGS. 1 to 3, reference numeral 1 denotes a connector, 2 denotes a contact piece, 6, 6' denote contact terminals, 7 (see FIG. 4) denotes a recess, an 8, 12 denote projections.

Figure 5:
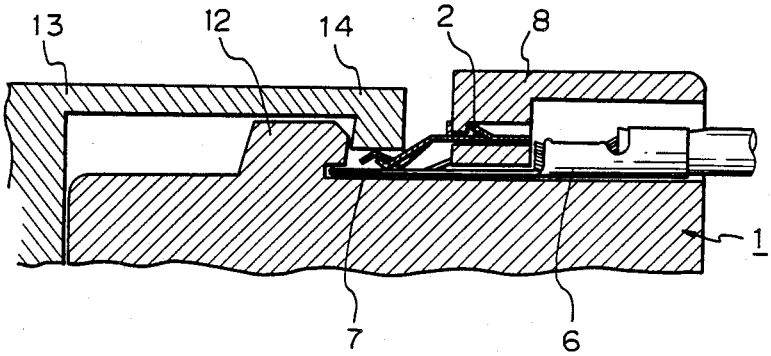
FIG. 5 is a sectional view taken along the line A—A of FIG. 1, showing the connector in fitting engagement with an other connector.

The connector 1 is provided on the outer side thereof with the recess 7 for engagement with an arm 14 of an other connector 13 (see FIG. 5). The projection 8 of the recess 7 is larger than the other projection 12 and has a cavity 9 for the contact terminals open at one end.

FIGS. 2A and 2B generally show the contact piece 2, which is made of a highly resilient material. The contact piece 2 comprises a base portion 2' and bifurcated free ends 3, 3'. As shown in FIG. 2A, one free end 3 is downwardly bent relatively deeply, and the forward end of the free end is upwardly bent. The other free end 3', which is longer than the one free end 3, is downardly bent relatively gently, upwardly bent at an intermediate portion, and downwardly bent at its forward end. As shown in FIG. 2B, the other free end 3' is provided at the extended portion thereof with upwardly bent portion 31.

The contact piece 2 is provided at the base portion 2' thereof with locking pieces 4 and 5. The locking piece 4 is stamped upwardly from the base portion 2' and the locking piece 5 stands upright from the forward edge of the base portion.

Figure 4:
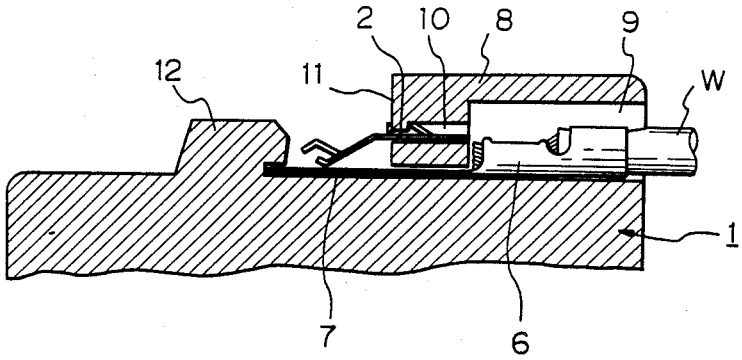
FIG. 4 is a sectional view of one connector taken along the line A—A of FIG. 1.

As shown in FIG. 4, the cavity 9 for the contact terminals has a gap 10 in front of it into which the contact piece 2 is inserted in opposition to the direction in which the contact terminals are inserted. The contact piece 2 is locked in the gap 10 by the locking pieces 4 and 5 through a depending portion 11. The two parallel contact terminals 6, 6' are inserted into the cavity 9 for the contact terminals in the direction in which the connectors 1 and 13 are fitted.

Now the relationship between the contact terminals 6, 6' and the contact piece 2 will be described. The one free end 3 of the contact piece 2 is normally in contact with one contact terminal 6, while the other free end 3' of the contact piece 2 is in the vicinity of the other contact terminal 6' with an adequate clearance left therebetween.

Further, the operation of the connector according to the present invention will be described with reference to FIGS. 4 and 5. During the fitting of the connectors 1 and 13, when an arm 14 of the connector 13 moves beyond the projection 12 and is caught in the recess 7, the forward end of the arm 14 urges the other free end 3' of the contact piece 2 downward into contact with the contact terminal 6' directly under it. At this time, the circuit which includes an indicating lamp is energized and indicates whether the fitting of the two connectors is perfect or not.

The connector according to the present invention provides the following distinct meritorious effects. In the prior art connector, the indicating lamp is lit even when the connectors are not perfectly locked to each other if the contact pieces are electrically connected to each other. In the present invention, however, the indicating lamp is not lit unless the connectors are perfectly locked to each other. Assembly of the electric contacts is relatively simple in the present invention too, and is in fact as simple as the harnessing work in the prior art connectors.

While we have shown and described specific embodiments of the invention, it will be understood that these embodiments are merely disclosed for the purpose of illustration and description and that various other forms may be devised within the scope of our invention, as defined in the appended claims.

What is claimed is:

1. A connector for connection to a complementary connector, comprising:

a connector housing haing a contact recess, a contact terminal cavity, and a contact piece gap;

a contact piece having a base portion and bifurcated free ends, said base portion of said contact piece disposed in said contact piece gap, and said bifurcated free ends of said contact piece extending into said contact recess; and wire contact terminals projecting from said contact terminal cavity into said contact recess of said connector housing;

one of said bifurcated free ends of said contact piece arranged so as to contact one of said wire contact terminals in said recess, and another of said bifurcated free ends arranged so as to contact another of said wire contact terminals when an arm of a complementary connector housing is connected to said contact recess to complete an electrical circuit between said wire contact terminals.

2. The connector as set forth in claim 1, wherein:

said bifurcated free ends extend from said base portion of said contact piece;

said one of said bifurcated free ends having a downwardly bent portion bent downward relatively sharply from said base portion toward said contact recess and an upwardly bent portion at the forward end of said downwardly bent portion; and said other of said bifurcated free ends, longer than said one of said bifurcated free ends, having a downwardly bent portion bent downward relatively gently from said base portion toward said contact recess, an upwardly bent intermediate portion at the forward end of said downwardly bent portion, and a downwardly bent forward portion at the forward end of said intermediate portion.

3. The connector as set forth in claim 1, wherein:

said bifurcated free ends extend from said base portion of said contact piece;

said one of said bifurcated free ends having a downwardly bent portion bent downward relatively sharply from said base portion toward said contact recess and an upwardly bent portion at the forward end of said downwardly bent portion;

said other of said bifurcated free ends, longer than said one of said bifurcated free ends, having a downwardly bent portion bent downward relatively sharply from said base portion toward said contact recess, a horizontally extending intermediate portion at the forward end of said downwardly bent portion, and upwardly bent portions extending upwardly from said intermediate portion.

4. A connector comprising:

a first connector housing, said housing provided with a locking portion on the outside thereof, said locking portion having a recess;

a second connector housing for connection with said first connector housing in a connecting direction, said second connector housing having an arm for engagement with said recess of said locking portion;

a pair of contact terminals in said recess parallel to said connecting direction of said first and second connector housings;

a highly resilient contact piece having bifurcated free ends, at least one of said bifurcated free ends disposed adjacent one of said contact terminals with a clearance therebetween such that when said arm of said second connector housing is engaged with said recess, said arm causes said at least one bifurcated free end to engage said one of said contact terminals.

* * * * *